US009468928B2

(12) United States Patent
Emmerich et al.

(10) Patent No.: US 9,468,928 B2
(45) Date of Patent: Oct. 18, 2016

(54) CRUSHING RING OF A CRUSHING ROLL

(71) Applicants: Jochen Emmerich, Nottuln (DE); Thomas Woestmann, Laer (DE)

(72) Inventors: Jochen Emmerich, Nottuln (DE); Thomas Woestmann, Laer (DE)

(73) Assignee: Hazemag & EPR GmbH, Dulmen (DE)

( * ) Notice: Subject to any disclaimer, the term of this patent is extended or adjusted under 35 U.S.C. 154(b) by 474 days.

(21) Appl. No.: 14/063,598

(22) Filed: Oct. 25, 2013

(65) Prior Publication Data

US 2014/0117133 A1 May 1, 2014

(30) Foreign Application Priority Data

Oct. 25, 2012 (EP) ..... 12189998

(51) Int. Cl.
*B02C 4/30* (2006.01)
*B02C 4/08* (2006.01)
*B02C 4/20* (2006.01)

(52) U.S. Cl.
CPC . *B02C 4/30* (2013.01); *B02C 4/08* (2013.01); *B02C 4/20* (2013.01)

(58) Field of Classification Search
CPC ..... B02C 4/305; B02C 4/30; B02C 4/08; B02C 4/28
USPC ..... 241/294, 300, 197
See application file for complete search history.

(56) References Cited

U.S. PATENT DOCUMENTS 4,781,331 A 11/1988 Potts
4,919,566 A * 4/1990 Caron ..... E02D 3/026 172/122
H00946 H * 8/1991 Lonn ..... E02D 3/026 172/122
7,377,459 B2 * 5/2008 Potts ..... B02C 4/18 241/197
7,900,861 B2 * 3/2011 Sharp ..... B02C 18/18 241/294
7,959,099 B1 * 6/2011 Cox ..... B02C 18/18 241/294
8,066,213 B2 * 11/2011 Marquardsen ..... B02C 13/06 241/242
8,814,073 B2 * 8/2014 Barber ..... B02C 4/30 241/189.1
9,302,267 B2 * 4/2016 Cascio ..... B02C 4/08
2006/0261202 A1 * 11/2006 Potts ..... B02C 4/18 241/236
2014/0034765 A1 * 2/2014 Lafond ..... B02C 4/08 241/197

FOREIGN PATENT DOCUMENTS

CN 201154311 Y 11/2008
EP 0 114 725 B1 8/1984
WO WO 03/006165 A1 1/2003

OTHER PUBLICATIONS

European Search Report of European Application No. EP 2 620 218 dated Apr. 25, 2013.

* cited by examiner

*Primary Examiner* — Faye Francis
(74) *Attorney, Agent, or Firm* — Fay Sharpe LLP

(57) ABSTRACT

A crushing ring of a crushing roll includes a base body with a through-opening, for connecting it to a shaft in a rotationally rigid fashion. At least one crushing tooth is in the form of a projection that is provided on the outer circumference of the base body and extends radially outward. A crushing cap encases the projection. The crushing cap includes a front wall section, a rear wall section and a head section that connects the two. A first pin-shaped connecting member detachably mounts the crushing cap on the projection. A second pin-shaped connecting member also detachably mounts the crushing cap on the projection. The second connecting member extends through the rear wall section of the crushing cap and is separably held in the projection.

20 Claims, 5 Drawing Sheets

CRUSHING RING OF A CRUSHING ROLL

BACKGROUND

The invention relates to a crushing ring of a crushing roll that comprises a base body with a through-opening, by means of which the base body can be connected to a shaft in a rotationally rigid fashion, at least one crushing tooth in the form of a projection that is provided on the outer circumference of the base body and extends radially outward, and a crushing cap that is assigned to a respective projection and encases the associated projection at least in the circumferential direction, wherein said crushing cap is realized with a front wall section referred to the rotating direction of the crushing ring, a rear wall section and a head section that connects the front wall section to the rear wall section, wherein a first pin-shaped connecting means is provided for separably mounting the crushing cap on an associated projection, and wherein said connecting means extends through the front wall section and is separably held in the projection.

The invention generally pertains to a machine for crushing different types of rocks. Such a crushing machine may be realized in the form of a double-roll crusher that is also referred to as "sizer" due to its modified construction. This sizer is used in the extractive industry for the primary size reduction of, for example, limestone, marble, gypsum, coal, ore and the like. The sizer comprises two crushing rolls that slowly rotate opposite to one another. These crushing rolls are provided with several crushing rings that are respectively equipped with relatively few crushing teeth. The feedstock is taken hold of by the crushing teeth and crushed between the crushing teeth, as well as in the gap between the crushing rolls, under the influence of a compressive and shearing load. An additional subsequent size reduction may take place between the crushing rolls and a so-called crushing bar that is arranged underneath the crushing rolls.

Crushing rolls of this type are used in roll-type crushers and known from the prior art, wherein the degree of size reduction depends, among other things, on the size, the shape and the configuration of the crushing teeth that are subjected to wear caused by the size reduction energy and therefore need to be replaced or exchanged from time to time in order to maintain the crushing or milling quality. Conventional crushing teeth are realized in the form of projections on the base body of a crushing ring that point radially outward, wherein the respective projections or crushing teeth are equipped with removable or exchangeable crushing caps, the exchange of which requires a certain effort. It is common practice to either weld or screw the crushing caps onto the corresponding projections of the base body of the crushing ring.

In a roll-type crusher of the firm MMD Design & Consultancy Limited that is known from the prior art, for example, several crushing rings of the initially cited type are slipped on a driven shaft. A respective crushing ring comprises several projections on its base body that represent the actual crushing teeth. In order to protect the crushing teeth from wear, a shell-shaped crushing cap is assigned to each respective projection or crushing tooth and can be exchanged, if so required. A bolt that is arranged parallel to the axis of the crushing roll and extends through projections of adjacent crushing rings may serve as separable mounting mechanism for the respective crushing caps. However, this has the disadvantage that this mounting tends to deflect during the very jerky operation of the crushing roll such that the screw-bolt connections are frequently difficult to separate due to the wear of the bolt heads and the corresponding nuts. A screw element that mounts the front and the rear wall section of the crushing cap on the respective crushing tooth or projection with the aid of a screw connection extending through the projection may serve as an alternative mounting option. In this case, however, it is disadvantageous that the screw connection generates an insufficient clamping effect and the screw has the tendency to separate from the respective projection or crushing tooth such that the corresponding crushing cap is also separated.

BRIEF DESCRIPTION

The invention is based on the objective of making available an improved crushing ring that ensures a permanent mounting of the crushing caps on the respective projections or crushing teeth, as well as a simple and reliable exchange of the crushing caps, in a constructively simple and cost-efficient fashion.

In a crushing ring of the initially described type, this objective is attained, according to the invention, in that a second pin-shaped connecting means is provided for separably mounting the crushing cap on the associated projection, wherein the second connecting means extends through the rear wall section of the crushing cap and is separably held in the projection, and wherein the longitudinal axis of the second pin-shaped connecting means extends at an angle of 90° relative to the rear wall surface of the projection referred to the rotating direction of the crushing ring or at an angle of less than 90° relative to the section of the rear wall surface that lies between the second connecting means and the head section. At an angle of 90°, the second pin-shaped connecting means essentially extends perpendicular or orthogonal relative to a rear wall surface of the projection referred to the rotating direction of the crushing ring while an angle of less than 90° results in the second pin-shaped connecting means, in contrast to an angle of 90°, extending more substantially in the rotating direction and being arranged at a greater incline.

Advantageous and practical embodiments and enhancements of the invention result from the dependent claims.

The invention makes available a crushing ring that is characterized by a compact and, in particular, backlash-free design. Due to the backlash-free mounting of the crushing cap on the respective projection or crushing tooth, no relative motions between the individual components and therefore no mechanical deformation of these components can occur. The connecting means completely brace a respective crushing cap around the associated projection or crushing tooth such that the front and rear wall sections rest on the corresponding wall surfaces of the projection without backlash and the wall sections of a corresponding crushing cap are in surface contact with the corresponding wall surfaces of the associated projection such that loads acting upon the crushing roll during the crushing process are transmitted to the projection of the base body of the crushing ring by means of the crushing cap. The invention therefore makes available a crushing ring, in which the effort for exchanging the crushing caps is minimal, but a reliable connection with the base body of the crushing ring is still ensured. The two connecting means mount the crushing cap on two opposite wall sides of a corresponding projection and therefore push the corresponding wall section of the crushing cap against the corresponding wall surface of the projection without the connecting means completely extending through the projection. In fact, the two connecting means that are laterally introduced into the projection end within the projection and their ends are fixed therein.

In order to improve the surface contact and the mounting of the crushing cap on the projection, an advantageous embodiment of the invention proposes that at least a front wall surface of a respective projection referred to the rotating direction of the crushing ring is inclined in the rotating direction of the crushing ring, wherein the first pin-shaped connecting means penetrates the front wall section in the region of its free end and extends into the projection in the region of its base. In this way, the crushing cap is pushed into the corner at the base of the projection such that the crushing cap can no longer be pulled off the projection due to crushing forces.

In order to further improve the mounting of the crushing cap on the projection, another embodiment proposes that the rear wall surface of a respective projection extends up to the base of the front wall surface of the corresponding projection such that it forms a base area of the base body of the crushing ring.

In order to completely brace the crushing cap around the respective projection, it is advantageous if the first pin-shaped connecting means and the second pin-shaped connecting means are mounted on the projection at an angle other than 180° between one another. Consequently, the two connecting means do not act along a common line of action, but—if the angle is suitably chosen—rather push the crushing cap in the direction of the center of the crushing ring.

In order to provide an option for separably mounting the two connecting means, an embodiment of the invention proposes that a respective projection features a through-bore that extends from the front wall surface to the rear wall surface of the projection and serves for mounting the first and the second pin-shaped connecting means. The bore through the projection may be realized linearly or curved and with or without a thread, wherein it would also be possible to realize the through-bore in a stepped fashion such that the cross section of the through-bore increases from the front wall surface to the rear wall surface of the projection.

In order to securely mount the crushing cap on one of the projections of the base body of the crushing ring, the through-bore may be realized with thread sections that receive corresponding pin-shaped connecting means with complementary thread sections.

According to another embodiment of the invention, it is alternatively proposed that a cylindrical mounting element is inserted into the through-bore of a respective projection and can be separably connected to the first and the second pin-shaped connecting means with the aid of a positive connection. In this case, the through-bore may be realized in a stepped fashion such that the cross section of the through-bore increases from the front wall surface to the rear wall surface of the projection or vice versa, wherein the positive connection may consist of a threaded connection. In a stepped through-bore, the mounting element may be inserted, for example, into the section of the bore that has the larger cross section and one of the two connecting means can be screwed into the mounting element through the smaller cross section such that the step of the bore serves as a sort of a stop that prevents the screwed-in connecting means from being pulled out.

In order to prevent the crushing cap from carrying out an axially directed motion, i.e. a motion that is laterally directed away from the projection, it is advantageous if the base body of the crushing ring comprises a peripheral web that is realized centrally on its peripheral edge and cooperates with a recess realized on the inner side of a respective crushing cap in order to inhibit a motion of the crushing cap in the axial direction. The peripheral web primarily prevents the crushing cap from carrying out a lateral motion or from laterally sliding off the projection, respectively.

With respect to the manufacture of the inventive crushing ring, it is advantageous if a radial gap is formed between the peripheral web of the base body and the recess realized on the inner side of the crushing cap in the mounted state of the crushing cap on an associated projection. In this way, elaborate machining or post-machining of the peripheral surface of the web can be eliminated. A radial gap also improves the support of the crushing cap on the projection. The risk of the crushing cap tilting on the projection is reduced due to the fact that the crushing cap does not rest on the web, but rather at least sectionally on the axial surfaces realized laterally of the web, wherein the support is improved, in particular, due to a wider supporting surface.

In order to prevent the crushing cap from laterally sliding off the projection, an embodiment of the invention proposes that the axial surfaces of the peripheral web of the base body abut on lateral surfaces of the recess of the crushing cap in the mounted state of the crushing cap on an associated projection. In this way, the crushing cap is firmly held in an essentially backlash-free fashion in the axial direction.

In order to increase the respective clamping effect or wedge effect of the front wall section of the crushing cap in the corner region of the front wall surface of the projection, an embodiment of the invention proposes that lateral sections of the peripheral edge of the front wall surface and the rear wall surface that are realized laterally of the peripheral web at least sectionally extend toward one another at an angle of less than 90° in the region of the base of the corresponding projection. For example, the angle may amount to 70°. However, it would also be conceivable that the angle lies in a range between 50° and 85°, preferably in a range between 60° and 80°, particularly in a range between 65° and 75°.

In order to improve the support of the crushing cap on a projection, an advantageous embodiment furthermore proposes that the lateral sections of the peripheral edge realized laterally of the peripheral web feature alternating supporting sections, on which the inner side of the crushing cap sectionally abuts, and spaced sections, between which and the crushing cap a radial gap is sectionally formed. In this way, the crushing cap firmly rests on predetermined and defined sections of the peripheral edge of the crushing ring with a close fit.

A particularly stable mounting of the crushing cap in its front region is achieved if the free end of the front wall section is in the mounted state pushed into a corner that is formed by the front and the rear wall surface and has an included angle of no more than 90° with the aid of the first connecting means, wherein the first connecting means presses a radial section, as well as a tangential section of the free end of the crushing cap, against supporting sections in this state.

When installing the cylindrical mounting element, an incorrect installation can be prevented if a first longitudinal end of the mounting element is adapted to the outer contour of the corresponding projection in such a way that the first longitudinal end ends flush with the rear wall surface while the second longitudinal end abuts on a step of the through-bore.

In order to securely brace a respective crushing cap around a corresponding projection, the invention ultimately proposes that the mounting element features receptacle bores for fixing the first and the second connecting means, wherein the receptacle bores are realized in the mounting element such that they extend toward one another at an angle other than 180°. If the two connecting means are realized in the form of screws and the two receptacle bores are realized in the form of threaded bores, they are screwed into the mounting element toward one another and therefore brace the entire crushing cap around the projection because the crushing cap is fixed on both sides of the projection, i.e. on the front and the rear wall surface, in the region of its base.

It goes without saying that the aforementioned characteristics, as well as the characteristics discussed below, can not only be used in the respectively described combination, but also in other combinations or individually without deviating from the scope of the present invention. The scope of the invention is defined by the claims only.

BRIEF DESCRIPTION OF THE DRAWINGS

Other details, characteristics and advantages of the object of the invention result from the following description in connection with the drawings that show a preferred exemplary embodiment of the invention. In these drawings.

DETAILED DESCRIPTION

Figure 1:
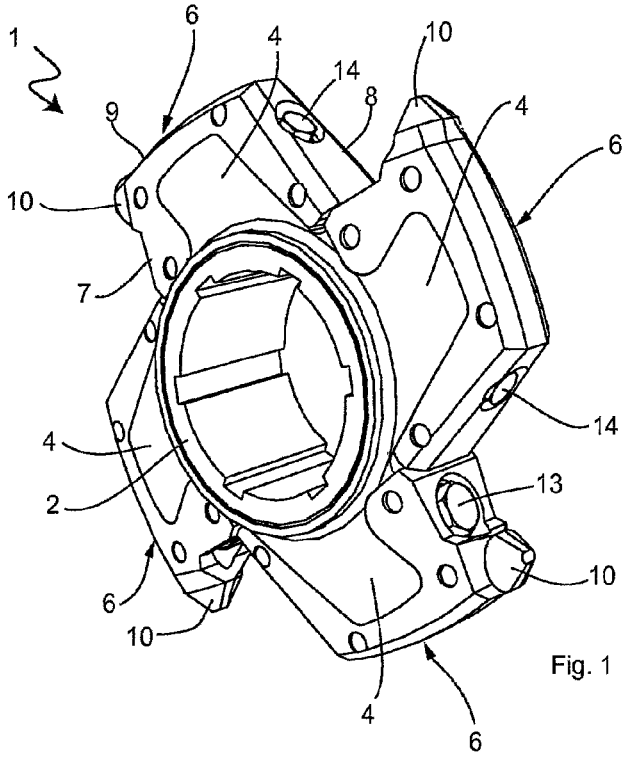
FIG. 1 shows an inventive crushing ring in the form of a perspective view.
Figure 2:
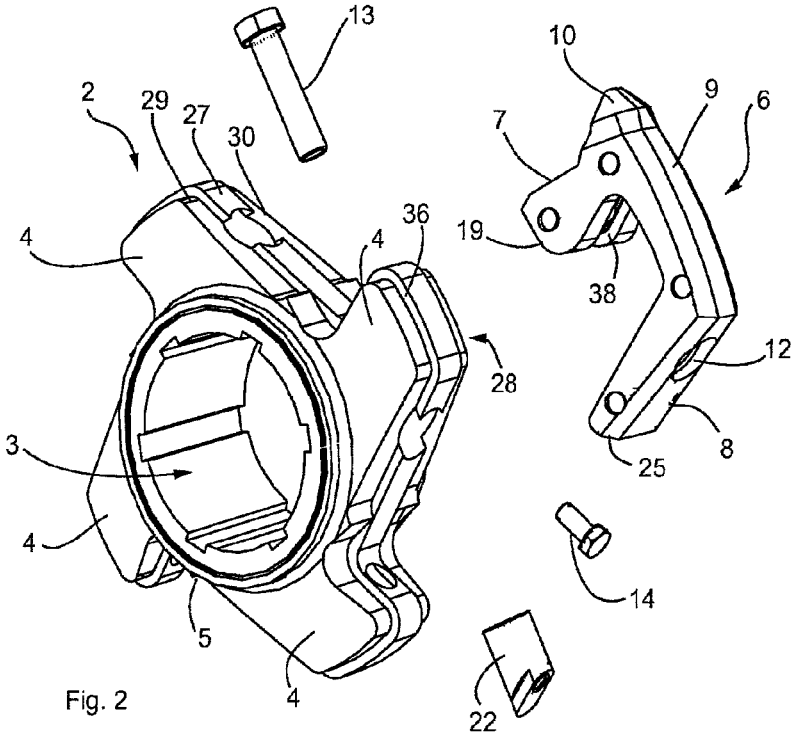
FIG. 2 shows the inventive crushing ring in the form of a perspective view of its individual components.
Figure 3:
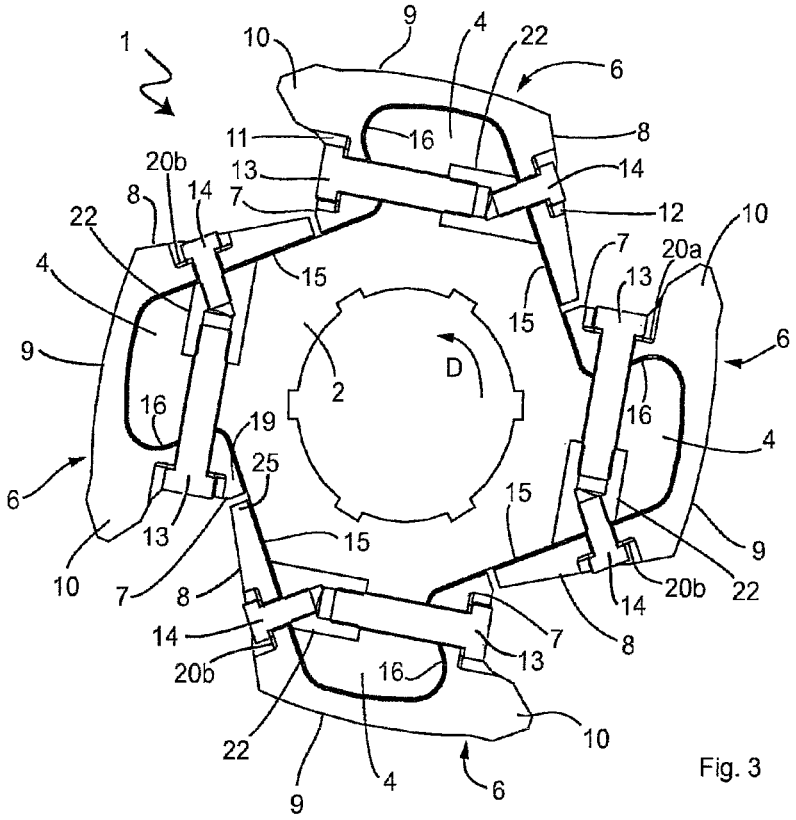
FIG. 3 shows the inventive crushing ring in the form of a cross-sectional view at the height of a peripheral web on the crushing ring.

FIG. 1 shows an inventive crushing ring 1 of a crushing roll in the form of a perspective view while the crushing ring 1 in FIG. 3 is illustrated in the form of a cross-sectional view. The crushing ring 1 comprises a base body 2 (see, for example, FIG. 2) with a through-opening 3 arranged in its center. The through-opening 3 can be connected to a not-shown shaft of the crushing roll in a rotationally rigid fashion in order to realize a rotatory motion of the crushing ring 1. In addition to the through-opening 3 for the shaft, the base body 2 features a total of four crushing teeth in the form of projections 4 that are arranged on the outer circumference 5 (see, for example, FIG. 2) of the base body 2 and extend radially outward from this base body. The four projections 4 are uniformly distributed over the circumference of the base body 2. In contrast to the embodiment shown, it would also be possible to provide more or fewer than four projections 4, but at least one projection should be provided.

A crushing cap 6 is assigned to each individual projection 4. A respective crushing cap 6 is realized in a U-shaped fashion and features a front wall section 7, a rear wall section 8 and a head section 9 that connects the front wall section 7 to the rear wall section 8. The front wall section 7 referred to the rotating direction D (see FIG. 3) of the crushing ring 1 corresponds to the wall section of the crushing cap 6 that faces the material to be reduced in size and initially encounters this material during the size reduction process. Accordingly, the rear wall section 8 of the crushing cap 6 referred to the rotating direction of the crushing ring 1 faces away from the material to be reduced in size and in terms of chronological order follows the front wall section 7 during the rotation of the crushing ring 1. A corresponding crushing cap 6 respectively encases an associated projection 4 at least in the circumferential direction of the base body 2 or encases at least the surface of the outer circumference 5, i.e. only lateral sections of the projection 4 are still visible in the mounted state of the crushing cap 6. It would naturally also be possible to realize embodiments of a crushing cap, in which the horn-shaped projection is completely encased by the crushing cap inclusive of the lateral regions. A corresponding crushing cap 6 features a pick-shaped crushing head 10 that respectively protrudes in the tangential direction referred to the base body 2 or in the circumferential direction and due to its arrangement initially encounters the object to be reduced in size during the size reduction process. If applicable, the crushing head 10 may consist of a material that is harder and/or more wear-resistant than the remaining crushing cap 6. This crushing head 10 may also be separably connected to the crushing cap 9.

Figure 6:
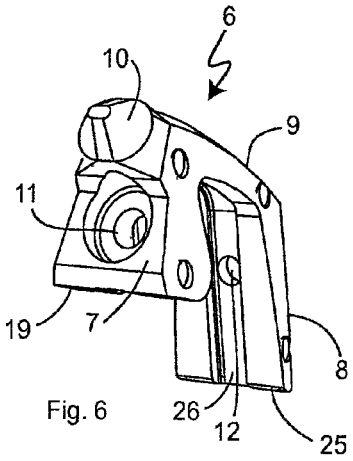
FIG. 6 shows a crushing cap in the form of a perspective view.
Figure 7:
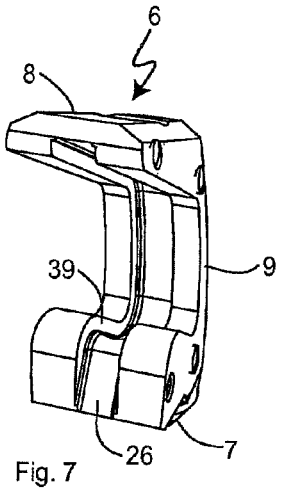
FIG. 7 shows the crushing cap according to FIG. 6 in the form of a different perspective view.
Figure 8:
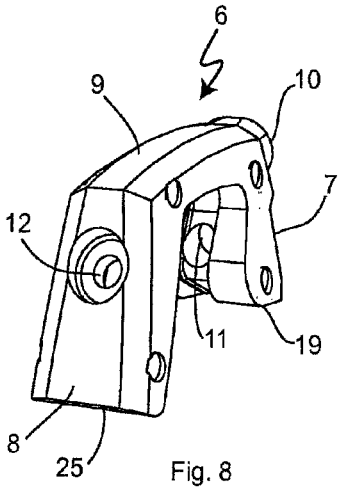
FIG. 8 shows the crushing cap according to FIG. 6 in the form of a perspective view from the rear.

A corresponding crushing cap 6 is illustrated, for example, in the form of a section in FIG. 3, wherein additional constructive details of the crushing cap 6 are illustrated in FIGS. 6, 7 and 8. The crushing cap 6 features a first stepped through-opening 11 in its front wall section 8. A second stepped through-opening 12 extends through the rear wall section 8 of the crushing cap 6. In order to install the crushing cap 6 on a corresponding or associated projection 4, a first pin-shaped connecting means 13 is inserted through the first through-opening 11 and a second pin-shaped connecting means 14 is inserted through the second through-opening 12. The first and the second connecting means 13 and 14 are respectively realized in the form of a screw, wherein the respective screw head is accommodated in the correspondingly widened cross section of the stepped first and second through-openings 11, 12 and supported on the corresponding step 20*a* or 20*b* of the respective through-openings 11, 12 as illustrated, for example, in the cross-sectional views according to FIGS. 3 and 4. In this way, the heads of the connecting means 13, 14 are accommodated in the through-openings 11, 12 in such a way that they are protected from damages during the crushing operation.

The crushing cap 6 is mounted on a corresponding projection 4 of the base body 2 with the aid of the aforementioned connecting means 13 and 14 that are respectively realized in a pin-like fashion. In more precise terms, the connecting means 13 and 14 are realized in the form of screws that are screwed into the projection 4 through the through-openings 11, 12 and therefore produce a separable connection. According to FIGS. 1 to 4, the crushing cap 6 is in this case mounted with a first connecting means 13 in the form of a large screw and a second connecting means 14 in the form of a small screw. Consequently, the screw-in length of the first connecting means 13 into the projection is greater than the screw-in length of the second connecting means 14, wherein this measure is adapted to the operating conditions because the front wall section 7 of the crushing cap 6 is subjected to greater loads than the rear wall section 8 and therefore needs to be fixed on the projection 4 stronger.

It is therefore proposed to use a first pin-shaped connecting means 13 and a second pin-shaped connecting means 14 for separably mounting the crushing cap 6 on a respective projection 4, wherein the first connecting means 13 extends through the front wall section 7 and is separably held in the projection 4, and wherein the second pin-shaped connecting means 14 extends through the rear wall section 8 of the crushing cap 6 and—in the exemplary embodiment shown—essentially perpendicular to a rear wall surface 15 of the projection 4 referred to the rotating direction D (see FIG. 3) of the crushing ring 1 and is separably held in the projection 4. In the exemplary embodiment shown, the second pin-shaped connecting means 14 therefore extends in such a way that an angle α (see FIG. 4) formed between its longitudinal axis 42 and the rear wall surface 15 amounts to 90°. It would alternatively be conceivable that the angle α referred to a section of the rear wall surface 15 that lies between the second connecting means 14 and the head section 9 amounts to less than 90°, in which case the longitudinal axis 42 (see FIG. 4) of the second connecting means 14 would extend more substantially in the direction of the through-opening 3 and the second connecting means 14 would be arranged at a much greater incline. In the installed state of the crushing ring 1, sections of the rear wall surface 15 of the projection 4 are in surface contact with sections of the inner surface of the rear wall section 8 of the crushing cap 6. Likewise, sections of the inner surface of the front wall section 7 of the crushing cap 6 are in surface contact with sections of the front wall surface 16 of the projection 4 in the installed state of the crushing ring 1 as described in greater detail below.

Figure 4:
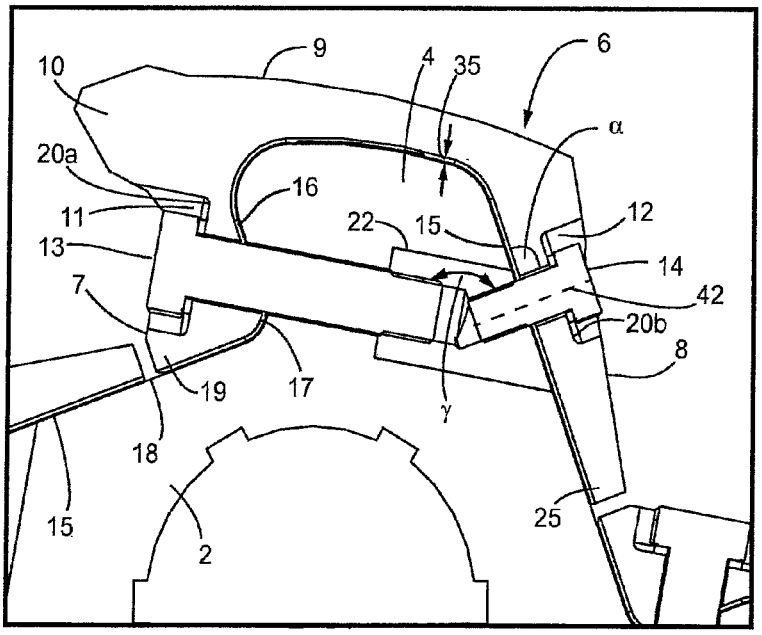
FIG. 4 shows an enlarged illustration of a detail of FIG. 3.

The front wall surface 16 of a respective projection 4 is furthermore inclined in the rotating direction D of the crushing ring 1 as illustrated, for example, in FIG. 3 or 4. Likewise, the rear wall surface 15 of the projection 4 is inclined in the rotating direction D of the crushing ring 1, wherein the front wall surface 16 extends parallel to the rear wall surface 15 in the embodiment shown, but this parallel alignment is not absolutely necessary. The two wall surfaces 15 and 16 may also be realized such that they do not extend parallel to one another, but the front wall surface 15 should in this case be inclined in the rotating direction D of the crushing ring 1. Due to the incline of the front wall surface 16, the crushing head 10 of the crushing cap 6 protrudes in the rotating direction D and therefore represents the first component of the crushing ring 1 that encounters the material to be reduced in size during the size reduction process. The rear wall surface 15 of a respective projection essentially extends to the base 17 (see, for example, FIG. 4 or 11) of the projection 4 or to the front wall surface 16 and in this case at least sectionally forms a sort of base area 18 of the base body 2 (see, for example, FIG. 4). The free end 19 (see FIG. 2, 3, 4 or 8) of the front wall section 7 of the crushing cap 6 is at least sectionally arranged in a sort of corner 34 (see FIGS. 12 and 13) of the base body 2 that is formed by the front wall surface 16 of the projection 4 and the base area 18 or by sections of the front and rear wall surfaces 15, 16 as described in greater detail below. The wall thickness of the front wall section 7 of a respective crushing cap 6 increases from the head section 9 in the direction of the free end 19 of the front wall section 7. In contrast, the wall thickness of the rear wall section 8 of a respective crushing cap 6 decreases from the head section 9 in the direction of the free end 25 (see, for example, FIG. 2 or 8) of the rear wall section 8.

Due to the incline of the projection 4 in the rotating direction D, the corner 34 (see, for example, FIG. 12), into which the free end 19 of the front wall section 7 of the crushing cap 6 is at least sectionally pushed with the aid of the first pin-shaped connecting means 13, i.e. with the larger of the two screws, is at least sectionally formed between the front wall surface 16 and the rear wall surface 15 or the base area 18, respectively. For this purpose, the first pin-shaped connecting means 13 penetrates the front wall section 7 in the region of the free end 19 and extends into the projection 4 in the region of the base 17. In this way, the larger front screw, i.e. the first pin-shaped connecting means 13, pushes the crushing cap 6 obliquely into the corner 34 of the base body 1 of the crushing ring 1. Consequently, the crushing cap 6 is prevented from being pulled off the horn-shaped projection 4 of the crushing ring 1 by the crushing force. Due to this construction, any relative motion between the crushing cap 6 and the crushing ring 1 or the base body 2 of the crushing ring 1 results in an increase of the clamping length of the larger screw, i.e. of the first pin-shaped connecting means 13, and therefore also of the prestressing force of the first connecting means 13.

The step 20*b* (see, for example, FIG. 3 or 4) of the through-opening 12 of the rear wall section 8 is realized parallel to the rear wall surface 15 of the projection 4 and represents the respective clamping plane for the second screw or the second connecting means 14. In the exemplary embodiment shown, the second connecting means 14 is introduced into the projection 4 perpendicular to the rear wall surface 15 and separably held therein. Consequently, the smaller rear screw, i.e. the second connecting means 14, is arranged perpendicular to the clamping plane and bends the entire crushing cap 6 around the horn-shaped projection 4 of the crushing ring 1. If a screw would be used that completely extends through the projection 4, this screw would not be able to act perpendicular to its clamping plane because the front and rear wall surfaces 15 and 16 extend parallel to one another. The clamping surfaces would rather slide on one another, the prestressing force would be reduced and the screw would ultimately become loose, wherein the latter is prevented with the invention. In comparison with the position illustrated in FIG. 4, the second connecting means 14 may alternatively also extend into the projection 4 through the rear wall section 8 in a substantially more inclined fashion with an angle α of less than 90°.

In order to respectively arrange the screws or the first and second connecting means 13 and 14 in such a way that both screw-like connecting means 13, 14 can fulfill their above-described function, the respective axes of the screws or of the connecting means 13, 14 need to extend at a certain angle to one another. In other words, it is important that the first pin-shaped connecting means 13 and the second pin-shaped connecting means 14 are mounted on the respective projection 4 at an angle other than 180° between the connecting means 13, 14. At an angle of 180°, both screws would be screwed into the projection 4 in the direction toward one another such that the above-described disadvantageous effect of sliding clamping surfaces would occur, wherein the angle γ between the two connecting means 13, 14 amounts to approximately 150° (see FIG. 4) in the exemplary embodiment illustrated in FIG. 4. According to FIG. 3 and also FIG. 11, a respective projection 4 features a through-bore 21 that extends from the front to the rear wall surface 16, of the projection 4 and serves for mounting the first and second pin-shaped connecting means 13, 14, wherein said through-bore extends linearly through the projection 4 and is realized in a stepped fashion such that the cross section of the through-bore 21 increases from the front wall surface 16 to the rear wall surface 15 in the exemplary embodiment illustrated in the figures. The cylindrical mounting element 22 is inserted into the section of the through-bore 21 that has the largest cross section. The mounting element 22 features receptacle bores 23 and 24 for fixing the first and the second connecting means 13, 14, wherein the receptacle bores 23, 24 are realized in the mounting element 22 such that they extend toward one another at an angle other than 180° (see FIG. 10). The receptacle bores 23, 24 are provided with threads such that they can be engaged with the connecting means 13, 14 realized in the form of screws. The mounting element 22 therefore forms a nut that is inserted into the projection 4 of the base body 2 of the crushing ring 1. The mounting element 22 in the form of a nut features the two threads. In this way, the mounting element 22 can be separably connected to the first and the second pin-shaped connecting means 13, 14 with the aid of a positive connection, namely the threaded connection. In the exemplary embodiment shown, the overall screw-in length (mounting element 22 plus projection 4) of the first connecting means 13 is greater than the overall screw-in length of the second connecting means 14 into the mounting element 22, wherein the first connecting means 13 is screwed into a respective projection 6 and into the mounting element 22 while the second connecting means 14 is merely screwed into the mounting element 22.

Figure 5:
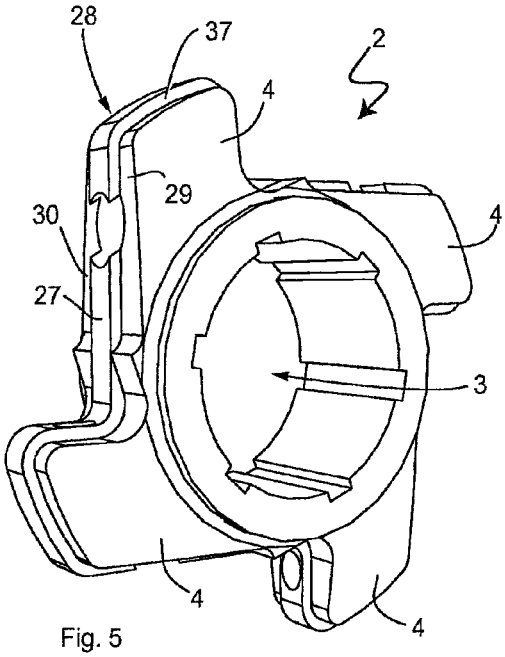
FIG. 5 shows a perspective view of a base body of the crushing ring.

In order to secure a respective crushing cap 6 from axially sliding off the projection 4, the crushing cap 6 features a recess 26 that is realized on its inner side as illustrated in FIGS. 6 and 7. This recess 26 in a respective crushing cap 6 cooperates with a web 27 that is realized centrally and peripherally on the peripheral edge 28 of the base body 2 of the crushing ring 1 (see FIGS. 2 and 5). The peripheral web 27 cooperates with the recess 26 realized on the inner side of the corresponding crushing cap 6 and inhibits a motion of the crushing cap 6 in the axial direction of the crushing ring 1. In other words, the horn-shaped projection 4 of the crushing ring 1 that serves for receiving the crushing cap 6 features a peripheral elevation or web 27 and the crushing cap 6 features an inner peripheral groove or recess 26. This engagement serves for securing the crushing cap 6 against an axial displacement of the crushing cap 6 on the projection 6. In this case, the web 27 does not completely abut on the recess 26 in the installed state of the crushing cap 6 on an associated projection 4. In fact, a radial gap 35 (see FIG. 4) is formed between the peripheral web 27 of the base body 2 and the recess realized on the inner side of the crushing cap 6 such that the forces that act upon the crushing ring 1 in the radial direction during the size reduction process do not directly act upon the web 27. The web serves for preventing the crushing cap 6 from axially sliding off the projection 4. This is the reason why axial surfaces 36, 37 (see FIGS. 2 and 5) of the peripheral web 27 of the base body 2 abut—in an essentially backlash-free fashion—on lateral surfaces 38, 39 (see FIGS. 2 and 7) of the crushing cap 6, wherein the axial surface 36 that acts as a contact surface is illustrated in the form of a surface that is colored black in FIG. 13.

Figure 11:
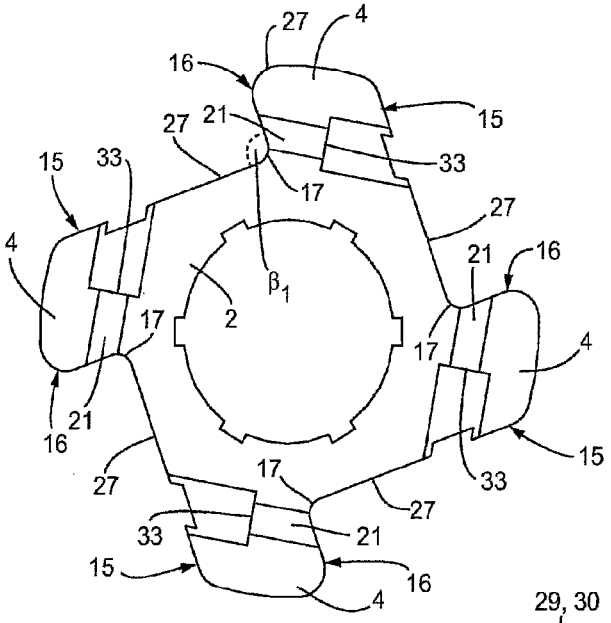
FIG. 11 shows an illustration of the base body of the crushing ring for a central cross section.
Figure 12:
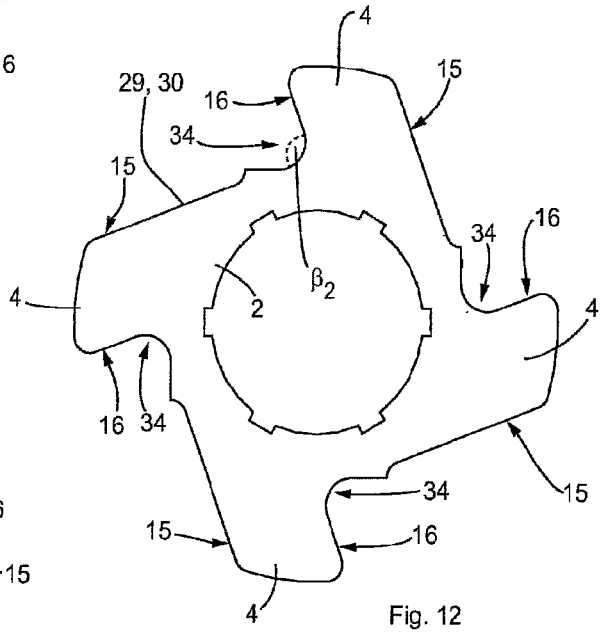
FIG. 12 shows an illustration of the base body of the crushing ring for a cross section on the end face of the base body.
Figure 13:
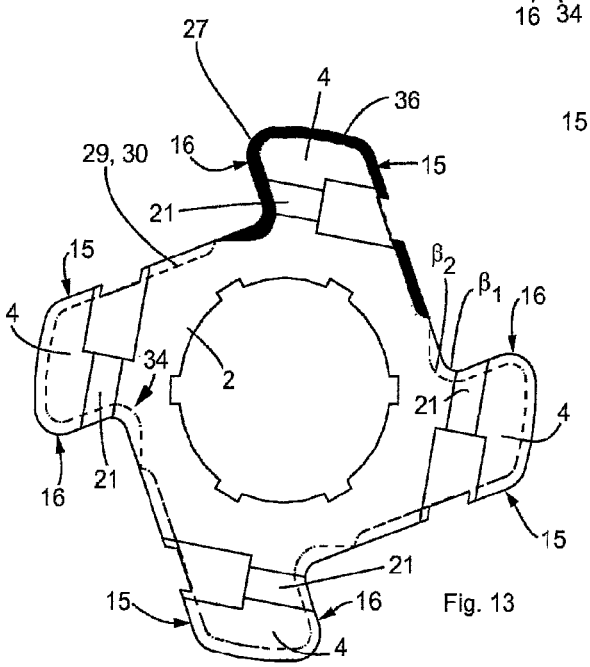
FIG. 13 shows a combined illustration of the two cross sections shown in FIGS. 11 and 12.

FIGS. 11 to 13 show an additional or further constructive measure for increasing the clamping effect or wedge effect of the crushing cap 6 during the size reduction process, wherein only the base body 2 of the crushing ring 1 is illustrated in these figures. It should furthermore be noted that FIG. 11 shows a view for an axial section through the peripheral web 27 while FIG. 12 shows an axial section laterally adjacent to the web 27 for one of the two lateral sections 29, 30. In FIG. 13, the two axial sections according to FIGS. 11 and 12 are illustrated on top of one another, wherein the axial section for one of the two lateral sections 29, 30 is illustrated with broken lines. In the embodiment shown, it is proposed that the (central) sections of the peripheral edge 28 of the front wall surface 16 and the rear wall surface 15 that feature the peripheral web 27 are realized such that they extend toward one another at an angle $\beta_1$ (see FIG. 11) of approximately 90° as illustrated in FIG. 11. In order to push the free end 19 of the front wall section 7 of a respective crushing cap 6 into the corner 34 (see, for example, FIG. 12) that is at least sectionally formed by the front and the rear wall surfaces 16, in a clamping fashion, the lateral sections 29 and 30 (see FIGS. 2 and 5) of the peripheral edge 28 of the front wall surface 16 and the rear wall surface 15 of the projection 4 that are realized laterally of the peripheral web 27 are at least sectionally realized such that they extend toward one another at an angle $\beta_2$ (see FIG. 12) of less than 90° in the region of the base 17 of the corresponding projection 4. The angle $\beta_2$ amounts to 70° in the embodiment shown, but different angles may also be used. It would be conceivable, for example, that the angle lies in a range between 50° and 85°, preferably in a range between 60° and 80°, particularly in a range between 65° and 75°. In FIG. 13, the different shape of the peripheral edge 28 of the base body 2 is illustrated due to the overlay of FIGS. 11 and 12, wherein the different inclination of the peripheral edge 28 and of the rear wall surface 15 of the respective projection 4 is apparent in the region of the corners 34.

Figure 14:
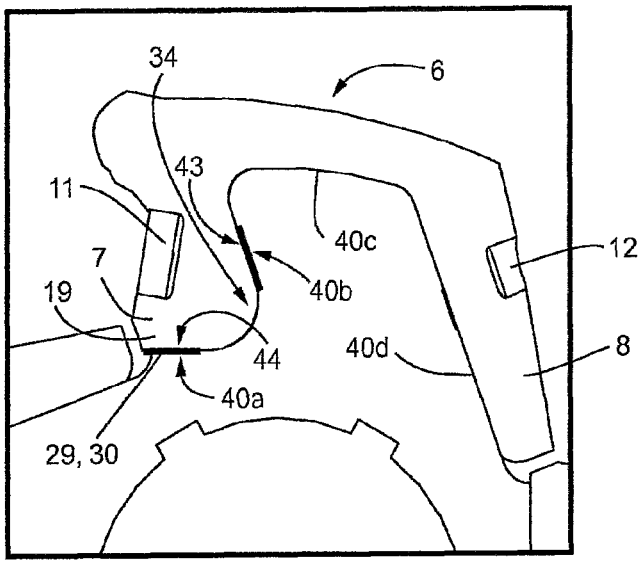
FIG. 14 shows the crushing ring in the form of a cross-sectional view at the height of a lateral section realized laterally adjacent to the peripheral web.
Figure 15:
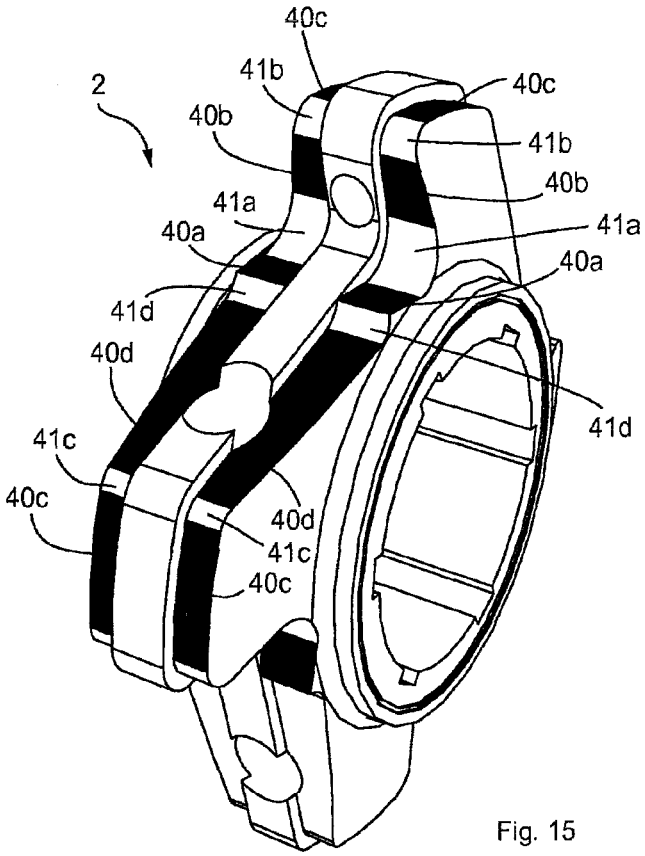
FIG. 15 shows the base body in the form of a perspective view, in which supporting sections and spaced sections are indicated on its peripheral edge.

As already mentioned above, a radial gap 35 is formed between the web 27 and the recess 26 in the radial direction of the crushing ring 1 while the axial surfaces 36, 37 of the web 27 abut on the lateral surfaces 38, 39 of the recess 26 in an essentially backlash-free fashion in the axial direction of the crushing ring 1. However, a corresponding crushing cap 6 does not completely abut peripherally on the lateral sections 29 and 30 realized laterally of the peripheral web 27 in the circumferential direction. In fact, the lateral sections 29, 30 of the peripheral edge 28 that are realized laterally of the peripheral web 27 feature alternating supporting sections 40*a*, 40*b*, 40*c*, 40*d* and spaced sections 41*a*, 41*b*, 41*c*, 41*d* as illustrated in FIGS. 14 and 15. FIG. 14 shows an axial section through the crushing cap 6 and the base body 2 in the region of a lateral section 29, 30 while FIG. 15 shows a perspective view of the base body 2, in which the supporting sections 40*a*, 40*b*, 40*c*, 40*d* are illustrated in the form of black surfaces. The inner side of the crushing cap 6 sectionally abuts on the supporting sections 40*a*, 40*b*, 40*c*, 40*d* realized on a corresponding lateral section 29, 30, wherein the supporting sections 40*a*, 40*b*, 40*c*, 40*d* identified by reference symbols in FIGS. 14 and 15 are realized on each of the projections 4 and accordingly recur over the circumference of the base body 2. This applies analogously to the spaced sections 41*a*, 41*b*, 41*c*, 41*d*, between which and the crushing cap 6 a radial gap is sectionally formed, such that the crushing cap 6 does not completely abut on the lateral sections 29 and 30, but rather only sectionally. In the exemplary embodiment shown, four supporting sections 40*a*, 40*b*, 40*c*, 40*d* and four spaced sections 41*a*, 41*b*, 41*c*, 41*d* are provided for each projection 4, but a different number may also be used. According to FIG. 14, the free end 19 of the front wall section 7 respectively abuts at least sectionally on the lateral wall sections 29, 30 on the rear wall surface 15 of the base body 2 and on the supporting sections 40*a* of the lateral sections 29 and 30. In the installed state, the free end 19 of the front wall section 7 is pushed into the corner 34 formed by the supporting sections 40*a* and 40*b* of the front and the rear wall surface 16, 15 with the aid of the first connecting means 13. In the exemplary embodiment shown, the corner 34 has an included angle $\beta_2$ of 70° (see FIG. 12) in the region of the lateral sections 29, 30. However, it would also be conceivable that the angle lies in a range between 50° and 85°, preferably in a range between 60° and 80°, particularly in a range between 65° and 75°. In this state, the first connecting means 13 presses an essentially radial section 43 and an essentially tangential section 44 (see FIG. 14) of the free end 19 of the crushing cap 6 against the supporting sections 40*a* and 40*b*. During the installation, the crushing cap 6 is therefore pushed into this position with the aid of the first connecting means 13, wherein the crushing cap 6 is subsequently braced around the projection 4 with the aid of the second connecting means 14 such that the crushing cap 6 comes in surface contact with the other supporting sections 40*c* and 40*d*.

Figure 9:
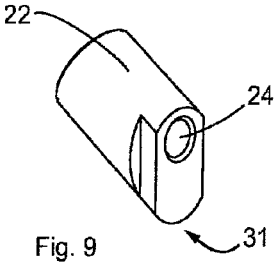
FIG. 9 shows a cylindrical mounting element in the form of a perspective view.
Figure 10:
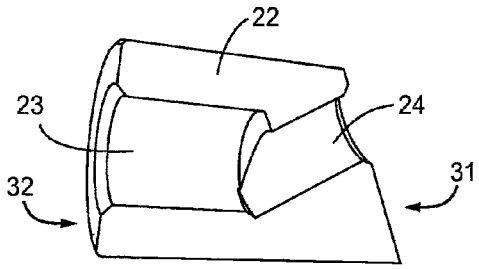
FIG. 10 shows the cylindrical mounting element according to FIG. 9 in the form of a cross-sectional view.

In order to ultimately secure the nut or the cylindrical mounting element 22 with the two threads against rotating during the installation, the mounting element 22 that is illustrated in greater detail in FIGS. 9 and 10 features a lateral recess that corresponds to the shape of the web 27 in its rear region or on its first longitudinal end 31. In this case, the first longitudinal end 31 of the mounting element 22 is adapted to the outer contour of the projection 4 and therefore of the web 27 in such a way that the first longitudinal end 31 ends flush with the rear wall surface 15 of the projection 4 while the other, second longitudinal end 32 of the mounting element 22 abuts on a step 33 (see FIG. 11) of the through-bore 21. The crushing cap 6 cooperates with the mounting element 22 due to the contour adaptation of the first longitudinal end 31 thereof such that the crushing cap 6 positively secures the mounting element 22 against rotating during the installation.

The above-described invention naturally is not limited to the described and illustrated embodiment. It is apparent that numerous modifications obvious to a person skilled in the art in accordance with the intended application can be carried out on the embodiment illustrated in the drawings without thusly deviating from the scope of the invention. In this respect, the invention includes everything contained in the description and/or illustrated in the drawings, as well as everything that is obvious to a person skilled in the art at variance with the concrete exemplary embodiments.

The invention claimed is:

1. A crushing ring of a crushing roll, comprising a base body with a through-opening, by means of which the base body can be connected to a shaft in a rotationally rigid fashion, at least one crushing tooth in the form of a projection that is provided on an outer circumference of the base body and extends radially outward, and a crushing cap that encases the projection at least in a circumferential direction, with said crushing cap including a front wall section in relation to a rotational direction of the crushing ring, a rear wall section and a head section that connects the front wall section to the rear wall section, wherein a first pin-shaped connecting member is provided for separably mounting the crushing cap on the projection, with said first connecting member extending through the front wall section of the crushing cap and being separably held in the projection, wherein a second pin-shaped connecting member is provided for separably mounting the crushing cap on the projection, wherein the second connecting member extends through the rear wall section of the crushing cap and is separably held in the projection, and wherein a longitudinal axis of the second pin-shaped connecting member extends at an angle ($\alpha$) of 90° relative to a rear wall surface of the projection in relation to the rotational direction of the crushing ring or at an angle of less than 90° relative to the section of the rear wall surface of the projection that lies between the second connecting member and the head section of the crushing cap.

2. The crushing ring according to claim 1, wherein at least a front wall surface of the projection is inclined in relation to the rotational direction of the crushing ring, wherein the first pin-shaped connecting member penetrates the front wall section of the crushing cap near a free end of the crushing cap and extends into the projection in near a base of the projection.

3. The crushing ring according to claim 2, wherein a rear wall surface of the projection extends up to a base of a front wall surface of another projection provided on the outer circumference of the base body such that it forms a base area of the base body.

4. The crushing ring according to claim 1, wherein the first pin-shaped connecting member and the second pin-shaped connecting member are mounted on the projection at an angle ($\gamma$) other than 180° between one another.

5. The crushing ring according to claim 1, wherein the projection comprises a through-bore that extends from the front wall surface to the rear wall surface of the projection and serves for mounting the first and the second pin-shaped connecting members.

6. The crushing ring according to claim 5, wherein a cylindrical mounting element is inserted into the through-bore of the projection and can be separably connected to the first and the second pin-shaped connecting members with the aid of a positive-locking connection.

7. The crushing ring according to claim 1, wherein the base body of the crushing ring comprises a peripheral web that is located centrally on a peripheral edge of the crushing ring and cooperates with a recess defined on an inner side of the crushing cap in order to inhibit a motion of the crushing cap in an axial direction of the crushing ring.

8. The crushing ring according to claim 7, wherein a radial gap is formed between the peripheral web of the base body and the recess defined on the inner side of the crushing cap in the mounted state of the crushing cap on the projection.

9. The crushing ring according to claim 7, wherein axial surfaces of the peripheral web of the base body abut on lateral surfaces of the recess of the crushing cap in the mounted state of the crushing cap on the projection.

10. The crushing ring according to claim 7, wherein lateral sections of the peripheral edge of the front wall surface and the rear wall surface of the crushing ring that are located laterally of the peripheral web at least sectionally extend toward one another at an angle of less than 90° in region of a base of the projection.

11. The crushing ring according to claim 10, wherein the lateral sections of the peripheral edge located laterally of the peripheral web feature alternating supporting sections, on which the inner side of the crushing cap sectionally abuts, and spaced sections, between which and the crushing cap is sectionally formed a radial gap.

12. The crushing ring according to claim 10, wherein a free end of the front wall section of the crushing cap is in the mounted state pushed into a corner that is formed by supporting sections of the peripheral lateral sections and has an included angle of no more than 90° with the aid of the first connecting member, wherein the first connecting member presses a radial section, as well as a tangential section of the free end of the crushing cap, against supporting sections in this position.

13. The crushing ring according to claim 6, wherein a first longitudinal end of the mounting element is adapted to an outer contour of the projection in such a way that the first longitudinal end ends flush with a rear wall surface of the projection while the second longitudinal end abuts on a step within the through-bore.

14. The crushing ring according to claim 6, wherein the mounting element includes receptacle bores for fixing the first and the second connecting members, wherein the receptacle bores are oriented in the mounting element such that they extend toward one another at an angle other than 180°.

15. A crushing ring of a crushing roll, comprising a base body with a through-opening, which is configured to allow the base body to be connected to a shaft in a rotationally rigid fashion, a crushing tooth including a first projection that is provided on the outer circumference of the base body and extends radially outward, and a crushing cap that is adapted to encase the first projection at least in a circumferential direction, said crushing cap including a front wall section in relation to a rotational direction of the crushing ring, a rear wall section and a head section that connects the front wall section to the rear wall section, a first pin-shaped connecting member for detachably mounting the crushing cap on the first projection, said first connecting member extending through the front wall section and being detachably held in the first projection, a second pin-shaped connecting member for detachably mounting the crushing cap on the first projection, wherein the second connecting member extends through the rear wall section of the crushing cap and is detachably held in the first projection, and wherein a longitudinal axis of the second pin-shaped connecting member extends at an angle ($\alpha$) of 90° relative to a rear wall surface of the first projection in relation to the rotational direction of the crushing ring or at an angle of less than 90° relative to the section of the rear wall surface that lies between the second connecting member and the head section of the crushing cap.

16. The crushing ring of claim 15, wherein a rear wall surface of the first projection extends up to a base of the front wall surface of a second projection provided on the outer circumference of the base body such that it forms a base area of the base body.

17. The crushing ring of claim 15, wherein the first pin-shaped connecting member and the second pin-shaped connecting member are mounted on the first projection at an angle ($\gamma$) other than 180° between one another.

18. The crushing ring of claim 15, wherein the first projection comprises a through-bore that extends from the front wall surface of the first projection to the rear wall surface thereof and serves for mounting the first and the second pin-shaped connecting members.

19. The crushing ring according to claim 18, further comprising a cylindrical mounting element that is inserted into the through-bore of the first projection and can be detachably connected to the first and the second pin-shaped connecting members with the aid of a positive-locking connection.

20. The crushing ring according to claim 15, wherein the base body of the crushing ring comprises a peripheral web that is located centrally on a peripheral edge of the crushing ring and cooperates with a recess defined on an inner side of the crushing cap in order to inhibit a motion of the crushing cap in an axial direction of the crushing ring.

* * * * *